United States Patent [19]

Kuchenbecker

[11] Patent Number: 5,000,320

[45] Date of Patent: Mar. 19, 1991

[54] PAPERBOARD CARTON HAVING A POUR SPOUT AND BLANK FOR FORMING THE SAME

[75] Inventor: Morris W. Kuchenbecker, Neenah, Wis.

[73] Assignee: James River Corporation of Virginia, Richmond, Va.

[21] Appl. No.: 563,361

[22] Filed: Jul. 19, 1990

Related U.S. Application Data

[63] Continuation of Ser. No. 378,077, Jul. 11, 1989, abandoned.

[51] Int. Cl.[5] ..... B65D 5/70

[52] U.S. Cl. ..... 206/611; 206/621.3; 206/621.4; 206/626

[58] Field of Search ..... 206/605, 611, 614, 615, 206/621.3, 621.4, 621.6, 621.7, 626, 631.2, 621.2

[56] References Cited

U.S. PATENT DOCUMENTS

| | | | |
|---|---|---|---|
| 1,956,238 | 4/1934 | Jackson | 229/17 |
| 2,360,415 | 10/1944 | Gilbert | 206/626 |
| 2,820,581 | 1/1958 | Makuta | 206/621.7 |
| 3,003,673 | 10/1961 | Clark et al. | 206/621.3 |
| 3,203,616 | 8/1965 | Bolton et al. | 206/621.4 |
| 3,226,003 | 12/1965 | Hickin | 229/17 |
| 3,250,436 | 5/1966 | Kurtz | 206/626 |
| 3,563,447 | 2/1971 | Katzenmeyer | 206/621.7 |
| 3,869,078 | 3/1975 | Braun | 206/621.2 |
| 3,971,506 | 7/1976 | Roenna | 206/621.7 |
| 4,317,518 | 3/1982 | Mode | 206/626 |
| 4,732,275 | 3/1988 | Hambleton et al. | 206/611 |
| 4,809,853 | 3/1989 | Weber | 206/621.4 |
| 4,887,718 | 12/1989 | Anderson et al. | 206/611 |

FOREIGN PATENT DOCUMENTS

| | | | |
|---|---|---|---|
| 615973 | 3/1961 | Canada | 206/621.3 |
| 2362872 | 9/1974 | Fed. Rep. of Germany | 206/621.4 |
| 2912717 | 10/1980 | Fed. Rep. of Germany | 206/626 |
| 2104708 | 4/1972 | France | 206/611 |

*Primary Examiner*—Gary E. Elkins

*Attorney, Agent, or Firm*—Sixbey, Friedman, Leedom & Ferguson

[57] ABSTRACT

A carton blank and carton having a reclosable tear open pour spout for dispensing contents of the carton is provided. The carton includes a plurality of side walls hingedly connected to one another by way of fold lines, a top wall and a bottom wall, with one of the side walls including an outer layer and an inner layer adhesively secured thereto. A discharge opening is formed in the inner layer, and a closure flap is integrally formed in the outer layer for overlying the discharge opening. A lift tab is also integrally formed in the outer layer and extends from the closure flap for opening the closure flap, with a tear strip also being integrally formed in the outer layer for releasing the lift tab to allow the consumer ready access to the lift tab to open the carton. The inner layer includes an adhesive area formed by a pair of adhesive regions which extend substantially parallel to the fold line between the side walls while an area, devoid of adhesive, which extends from the discharge opening and between the adhesive regions is maintained.

21 Claims, 7 Drawing Sheets

PAPERBOARD CARTON HAVING A POUR SPOUT AND BLANK FOR FORMING THE SAME

This application is a Continuation of Ser. No. 07/378,077, filed July 11, 1989 now abandoned.

TECHNICAL FIELD

The present invention relates to a pour spout for a paperboard carton, and more particularly to a vertically opening and reclosable pour spout formed in a side wall of a paperboard carton.

BACKGROUND ART

Paperboard cartons having a variety of varying pour spouts located on a side wall or top wall of the carton have been manufactured for many years. These pour spouts have been separately formed of metal, plastic or paperboard or simultaneously formed in the paperboard constituting the carton.

Early cartons, similar to that disclosed in U.S. Pat. No. 1,956,238 to Jackson, required both a closure flap and a covering flap which covers the opening once the carton is initially opened. The closure flap is formed as an integral part of the side wall and must be forced open by the consumer. This force will cause the closure flap to extend into the interior of the carton, which can obstruct the opening during discharge of the contents. Further, the covering flap is initially secured to the side wall by an adhesive which when opened by the consumer may tear in a non-uniform manner and permanently damage the flap or carton rendering reclosure of the carton impossible.

In an effort to overcome the shortcomings of this reclosable opening, U.S. Pat. No. 3,226,003 to Hicken discloses a reclosable opening feature formed in the side wall of a carton which may or may not include a covering flap. In order to gain access to the contents of the carton, a lift tab is provided as an extension of the closure flap which must be grasped and lifted by the consumer. For this to be accomplished, that portion of the paperboard carton about the lift tab must be removed during manufacture of the paperboard blank and an area of the cooperating end panel underlying the lift tab must be free of adhesive in order to allow the consumer to lift the lift tab. As noted, the manufacture of this carton requires removal of paperboard material as well as a specific void in the adhesive layer. This may lead to the possibility that the lift tab will be secured to the underlying panel or that the underlying panel will not adhere to the desired portions of the overlying panel when the resultant carton is formed. Additionally, if the paperboard material is not properly removed, the lift tab will not be accessible. With such a structure, the lift tab of the carton may not be readily grasped, by the consumer due to the adhesive which must be placed on the portion of the underlying panel between the lift tab and the carton opening. This will in turn make it difficult to initially lift the lift tabs.

Similarly, U.S. Pat. No. 4,809,853 to Weber, discloses a carton having a pour spout opening for dispensing the contents of the carton. As in U.S. Pat. No. 3,226,003, adhesive is provided about the entire periphery of the pour spout opening which may lead to the unintended adhering of the lift tab to the underlying flap containing the pour spout opening. Further, the resultant carton requires the removal of a portion of the overlying panel containing the closure element to facilitate access to a lift tab this may also lead to the obstruction of the lift tab if not properly removed.

Clearly there is a need for a carton which includes a pour spout in which the initial opening of the carton can be readily accomplished by the consumer and which may be reliably reclosed after the dispensing of a portion of the contents.

SUMMARY OF THE INVENTION

A primary object of the present invention is to overcome the disadvantages associated with the pour spouts disclosed in the prior art as discussed above. Specifically, it is an object of the present invention to provide a pour spout for a carton which may be readily and repeatedly opened and reclosed when desired by the consumer.

A further object of the present invention is to provide a reclosable pour spout feature which includes a lift flap releasing means which reliably draws the lift flap out of the plane of the paperboard carton to allow the consumer to readily grasp the lift flap and open the pour spout.

Another object of the present invention is to provide a reclosable pour spout feature including a secondary tab which provides the consumer with a reliable means for reopening the pour spout.

Another object of the subject invention is to provide a reclosable pour spout carton which includes a reclosable closure flap hinged along a horizontal top edge of a vertical panel of the carton and provided with an opening lift tab which is moved to a operative position by a releasing means in the form of a removable tear strip.

Yet another object of the present invention lies in the ability to effectively reclose the pour spout by frictionally engaging the lift tab in the discharge opening or by snapping the lower edge of the closure flap over the lower edge of the discharge opening.

These, as well as additional advantages of the present, are achieved by providing a paperboard blank having a tear open pour spout including a first major panel having first and second side walls and end flaps hingedly secured thereto by way of fold lines, and a second panel having third and fourth side walls and end flaps hingedly connected thereto by way of fold lines with the second and third side walls being congruent. A discharge opening is provided in the fourth side wall and a closure flap is integrally formed in the first side wall such that when a carton is formed from the blank. the closure flap overlies and covers the discharge opening. The closure flap also includes a lift tab which is hingedly connected to the closure flap by may of a fold line such that the lift tab may be pivoted relative to the closure flap.

When the carton is to be initially opened, a tear strip integrally formed in the first side wall is removed which releases the lift tab which may be readily grasped and lifted by the consumer. Because the closure flap is bound by two pairs of reverse cut score regions, by exerting an upward force on the lift tab, a ply separation occurs between each pair of reverse cut scores which allows the closure flap to be smoothly and uniformly opened.

Once the desired amount of contents have been dispensed from the carton, the lift tab may be inserted into the discharge opening in order to reclose the carton. In a preferred embodiment, a secondary lift tab is provide which contacts are outer portion of the carton to prevent the closure flap from being inserted into the carton as well as to aid the consumer in reopening the carton in order to further dispense its contents.

DETAILED DESCRIPTION OF THE PREFERRED EMBODIMENT

Figure 1:
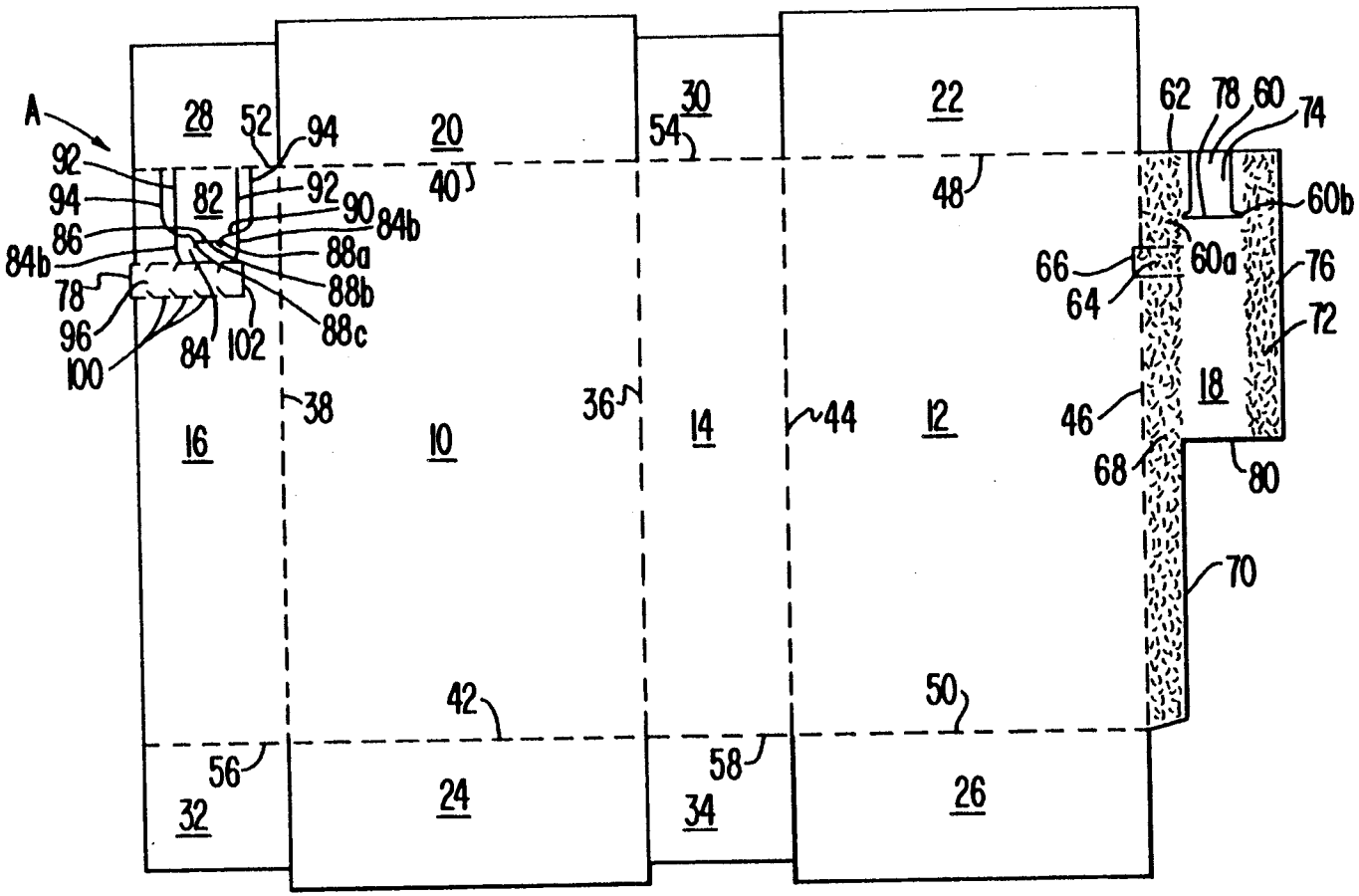
FIG. 1 is a plan view of a cut and scored paperboard blank for forming a carton in accordance with the present invention.

Referring now to the drawings, the invention will be described in greater detail with like elements of the several figures being referenced by like numerals. This invention is an improvement over the reclosable spout structure disclosed in U.S. application Ser. No. 294,433, filed January 6, 1989, the disclosure of which is incorporated by reference. FIG. 1 of the drawings illustrates a unitary blank A of foldable sheet material from which the carton B illustrated in FIG. 2 may be formed. The unitary blank A may be formed of a paperboard material or other conventional material for forming cartons of this type depending upon their intended use. The unitary blank A includes a main front panel 10, a main back panel 12, side panel 14, which is integrally connected to both the front panel 10 and the back panel 12, as well as a side panel 16 and a partial side panel 18. The carton blank A further includes top end panels 20 and 22, bottom end panels 24 and 26, as well as minor flaps 28, 30, 32, and 34. The particular end flap closing structure may take a variety of configurations while not departing from the intended scope of the invention. The front main panel 10 is hingedly connected to both the side panel 14 and side panel 16 as well as top end panel 20 and bottom end panel 24 by way of prescored fold lines 36, 38, 40, and 42, respectively. Likewise, the back panel 12 is hingedly connected to side panel 14, partial panel 18, top end panel 22 and bottom end panel 26 by way of prescore fold lines 44, 46, 48, and 50 respectively. Further, minor flaps 28, 30, 32, and 34 are hingedly connected to side panels 14 and 16 by way of prescore fold lines 52, 54, 56, and 58, respectively. By folding the carton blank A along the above described prescore fold lines, the carton B illustrated in FIG. 2 will be formed.

The partial side panel 18 includes a pour spout opening 60 which may be of a T-shaped configuration which is cut from an upper portion of the partial panel 18 with the upper limit of the opening 60 being colinear with the upper die-cut edge 62 of partial side panel 18. Partial side panel 18 further includes the area 64, defined by a boundary of interrupted cut scores or perforations, having an extension portion 66 which projects onto the back panel 12 along the vertical prescored fold line 46. The significance of this partially cut score area 64 will be described in greater detail hereinbelow.

As can be further noted from FIG. 1, the partial side panel 18 includes an adhesive coated portion 68 which extends the entire length of the partial side panel 18 between the prescore fold line 46 and the vertical line intersecting die-cut line 70 and the left most boundary point **60*a* of the T-shaped pour spout 60. The partial side panel 18 further includes a second adhesive coated portion 72 extended between a vertical line intersecting the right most boundary point 60*b* of the pour spout opening 60 and the free edge 76 of the partial side panel 1*g*. It is apparent from FIG. 1 for reasons to be discussed in greater detail hereinafter, that the partial side panel 18 is devoid of any adhesive coating in the region separating by the adhesive coated portions 68 and 72, the lower die-cut line 78 of the pour spout opening 60 and the die-cut line 80 of partial panel 18**.

Side panel 16 of the carton blank A includes an closure flap 82 which cooperates with the pour spout opening 60 to cover such pour spout opening when the carton blank A is in its formed condition. The closure flap 82 includes a lift tab 84 defined at its lateral sides by die cuts **84*a* and 84*b* which includes a secondary lift tab 86, integrally formed therein by die-cut lines 88*a*, 88*b*, and 88*c*. As can be noted, the die-cut lines 88*a* and 88*c* extend from the fold line 90 to a position below die-cut line 88*b* which is formed between the die-cut lines 88*a* and 88*c*, such that when the lift tab 84 is folded along fold line 90 the secondary lift tab 86 will readily pop loose from tab 84 and remain in the plane formed by closure flap 82**.

The closure flap 82 is integrally formed in side panel 16 by partial cut scores 92 and 94. These partial cut scores are cut to a depth of approximately 50% of the paperboard material from which the carton B is formed with the partial cut scores 92 being formed on an inner side of the paperboard blank A and the partial cut scores 94 being formed in the outer side of the carton blank A. In doing so, when an upward force is applied to the closure flap 82 by way of the lift tab 84 by the consumer, a ply separation will occur between the inner and outer partial cut score lines which allows for a smooth and uniform separation of the paperboard material between these lines. As can be further noted, the closure flap 82 is formed in a manner such that the fold line 52 forms the hinge line of the closure flap 82.

In order for the consumer to gain access to the lift tab 84, a tear strip 96 is provided. This tear strip 96 includes an extension 98 which overlies and is adhered to the extension 66, previously described, when the carton blank is in its formed condition. The tear strip 96 may be formed in a conventional manner using a plurality of die-cuts 100 and an end die-cut 102 such that the tear strip 96 may be selectively removed upon the initial opening of the carton. As will be described in greater detail hereinafter, when it is desired to initially open the carton B, the consumer will forcibly release the tear strip 96 which will, during its removal, unleash the lift tab 84 from the planar surface of side panel 16.

Figure 2:
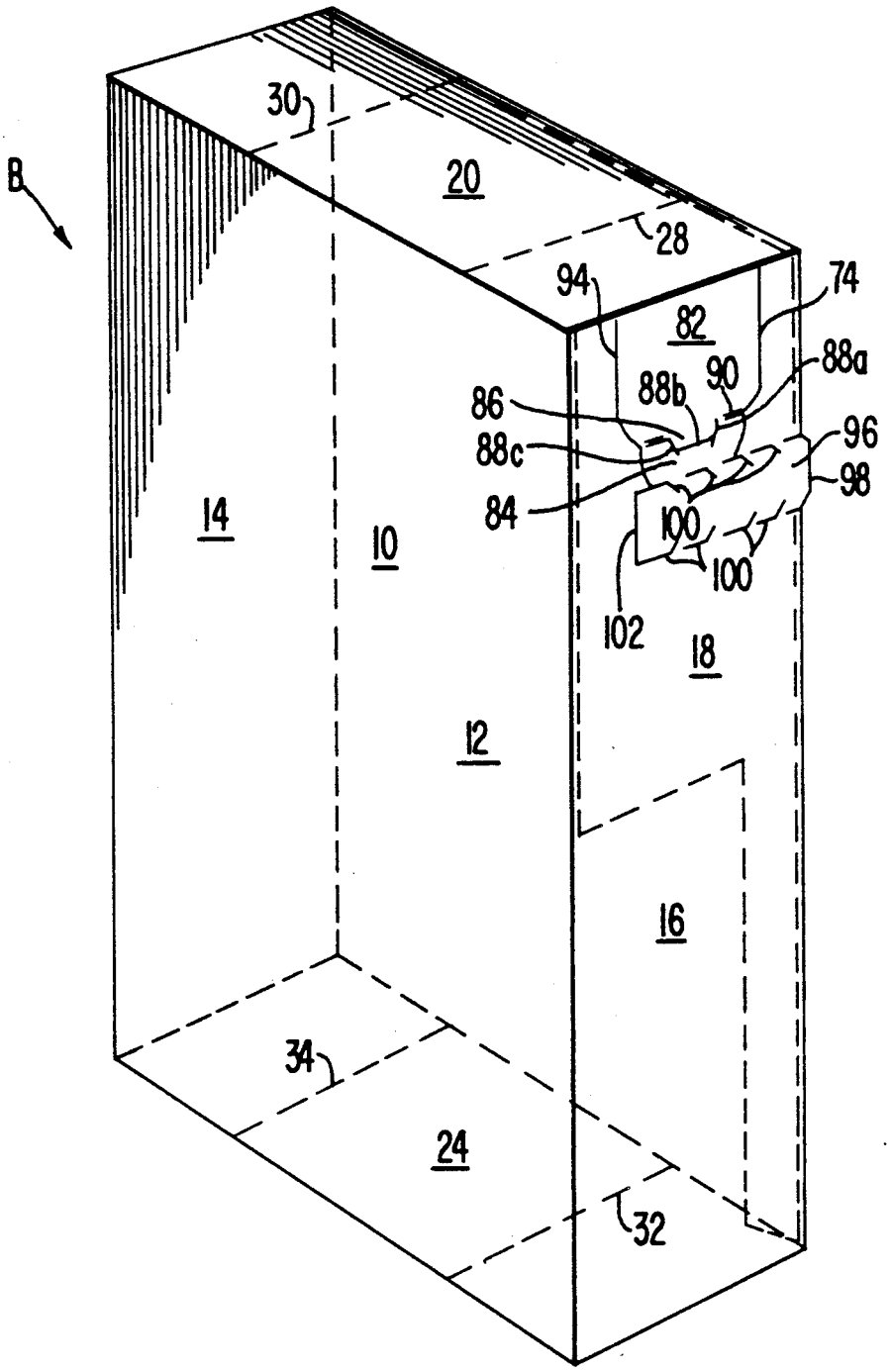
FIG. 2 is a perspective view of a fully erect carton in its initial condition formed from the paperboard blank of FIG. 1.
Figure 3:
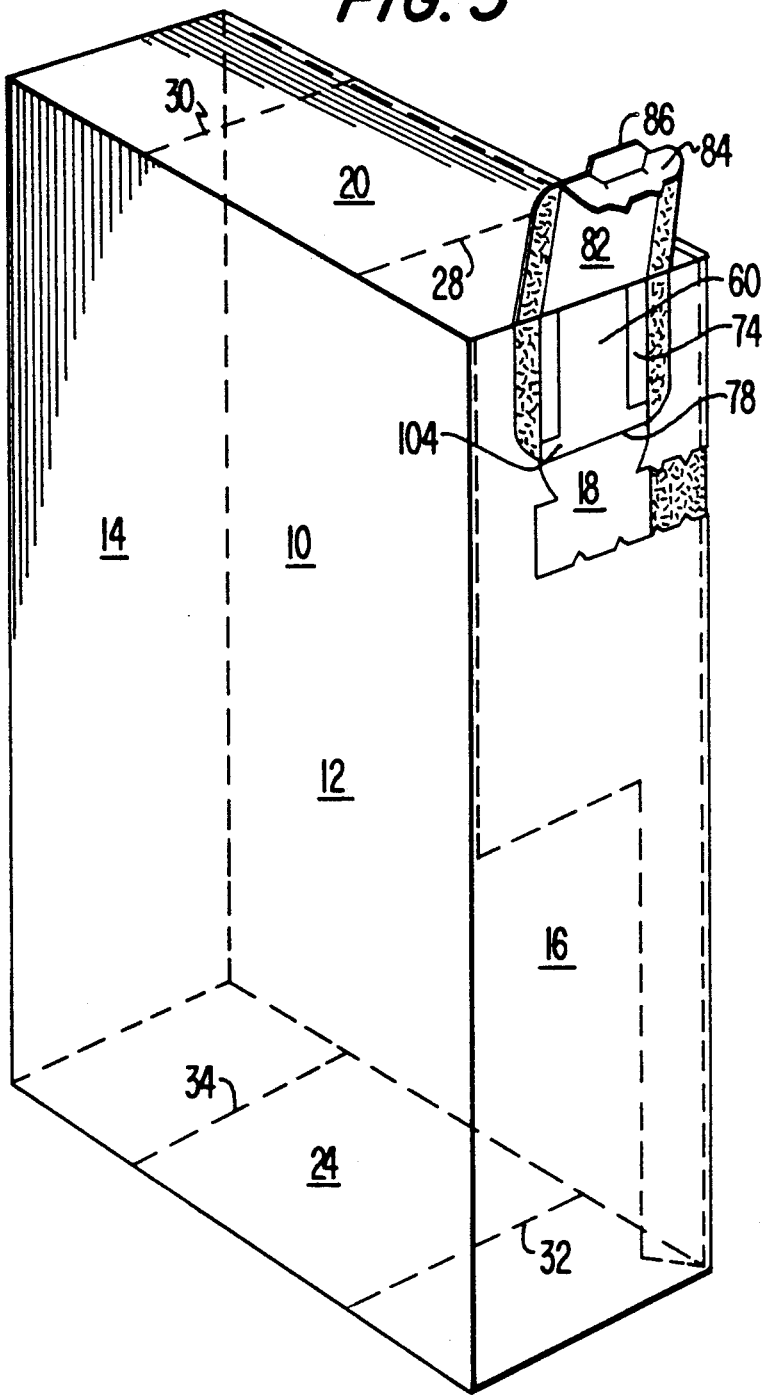
FIG. 3 is a perspective view of the carton of FIG. 2 in an open condition.
Figure 4:
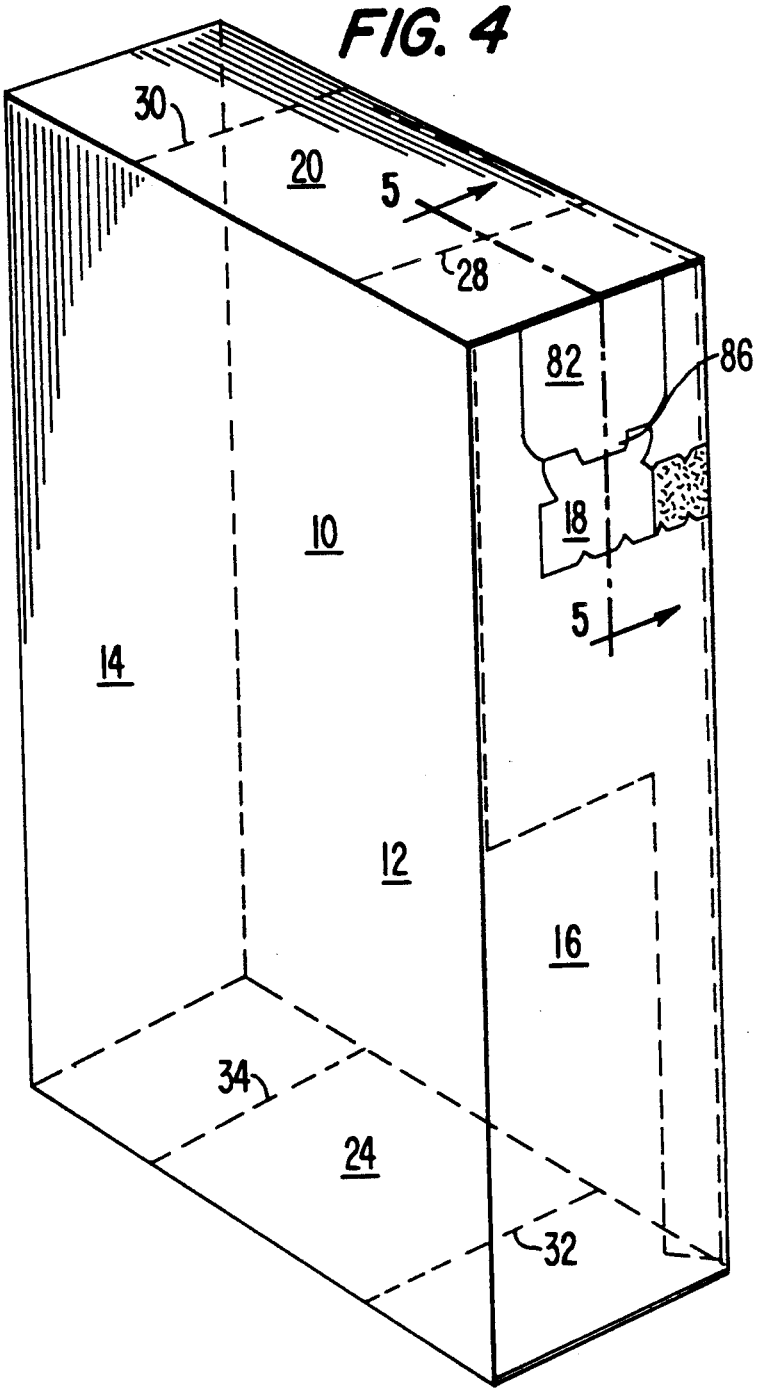
FIG. 4 is a perspective view of the carton of FIG. 2 in the reclosed condition.

Turning now to FIGS. 2, 3, and 4, the sequential initial opening and reclosing of the carton B will be explained in greater detail. As shown in FIG. 2, the carton B is formed by folding the front panel 10 and back panel 12 about the side panel 14 along fold lines 36 and 44 as well as folding side panel 16 along fold line 38 and partial panel 18 along fold line 46. Once in this condition, side panel 16 may be positioned over and adhered to the partial panel 18 along adhesive sections 68 and 72. Subsequently, the top and bottom panels, as well as the minor flaps may be folded in order to close and form the carton B. As can be seen from FIG. 2, by positioning side panel 16 to overlay partial side panel 18, the closure flap 82 will overlay and cover the pour spout opening 60. Further, the tear strip 96 and more particularly, the extension 98, will overlay and adhere to the partial die-cut section 64 and the extension portion 66.

In order to initially open the carton B, the consumer will apply an outward force to the extension 98 which will result in a ply separation at the die-cut portion 64 as well as a continuous tear along the die-cuts 100 forming the tear strip 96 until the end diecut 102 is reached. At this point the tear strip 96 will be released from the side panel 16 and may be discarded by the consumer. The outward force exerted on the tear strip 96 will inherently draw the lift tab 84 out of the plane formed by the side panel 16 by bending tab 84 along its fold line 90. In doing so, the consumer's access to the lift tab 84 is greatly facilitated. Once in this condition, the consumer need merely draw upwardly on the lift tab 84 which will result in the ply separation of the closure flap 82 in the region between the inner and outer partial die-cuts 92 and 94. This will allow the pour spout opening 60 to be uncovered for gaining access to the contents of the carton as shown in FIG. 3.

When it is desired to reclose the carton B, the lift tab 84 is back folded along fold line 90 which exposes the secondary lift tab 86 such that the carton may be reclosed by inserting the lift tab 84 into the pour spout opening 60 and preferably the cross-bar portion 104 of the inverted T-shaped pour spout opening, the secondary lift tab 86 will contact the underlying partial side panel 18 for both preventing the closure flap 82 from being inadvertently inserted within the carton B as well as to provide the consumer with a mechanism for readily reopening the carton when desired.

Figure 5:
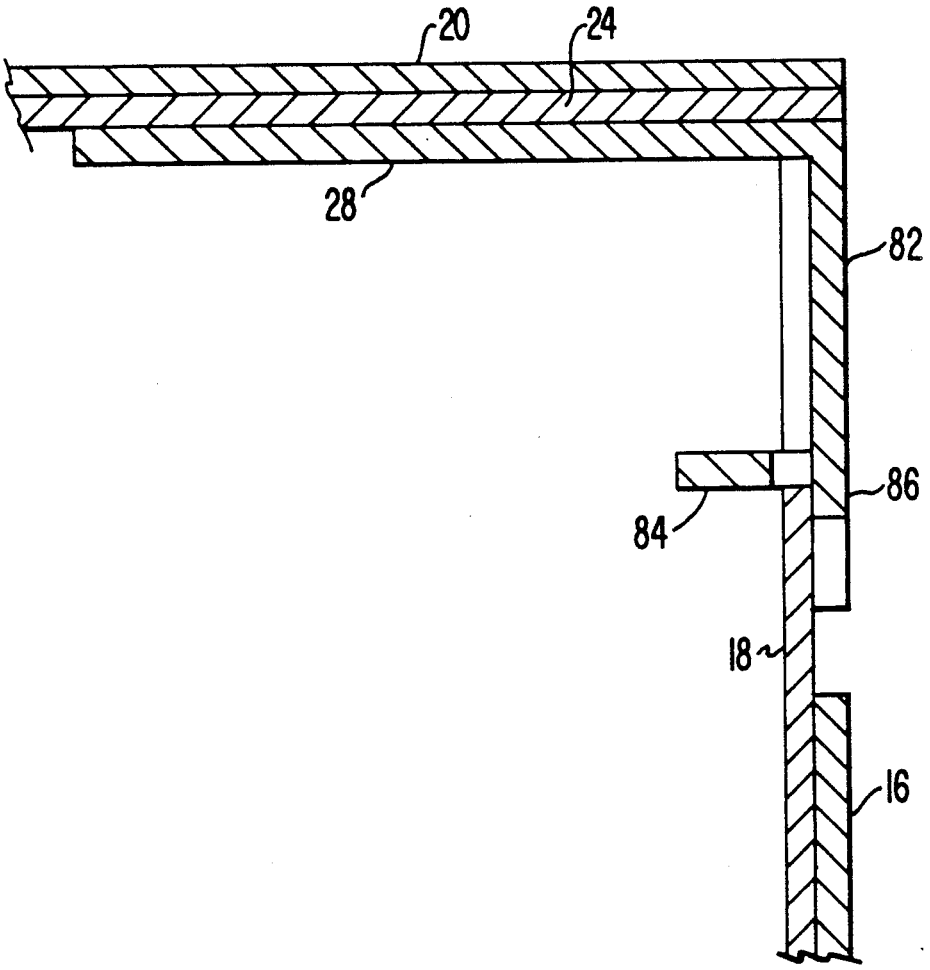
FIG. 5 is an expanded cross-sectional view of the reclosed carton taken along line V—V of FIG. 4.

FIG. 5 of the drawings illustrates the insertion of the lift tab 84 in greater detail. As described previously, the consumer need only lift the secondary lift tab 86 in order to regain access to the contents of the carton to repeat the dispensing of the contents.

It should be noted from FIGS. 1 and 3, that there is no adhesive applied to the region below the die-cut line 78 of the partial panel 18. In doing so, the possibility of misapplying the adhesive and inadvertently adhering the lift tab 84 to the partial panel 18 is eliminated. Therefore, upon the tearing away of the tear strip 96, the lift tab 84 will be readily accessible by the consumer. It should further be noted that the lateral width of the lift tab 84 is to be slightly greater than the lateral width of the cross-bar 104 of the T-shaped opening 60, such that upon insertion of the lift tab 84 into this portion of the pour spout opening 60, frictional engagement will exist so as to retain the lift tab 84 within the crossbar portion of the pour spout opening 60 to hold the opening panel 82 in its closed position until the closure flap 82 is reopened by the consumer.

Figure 6:
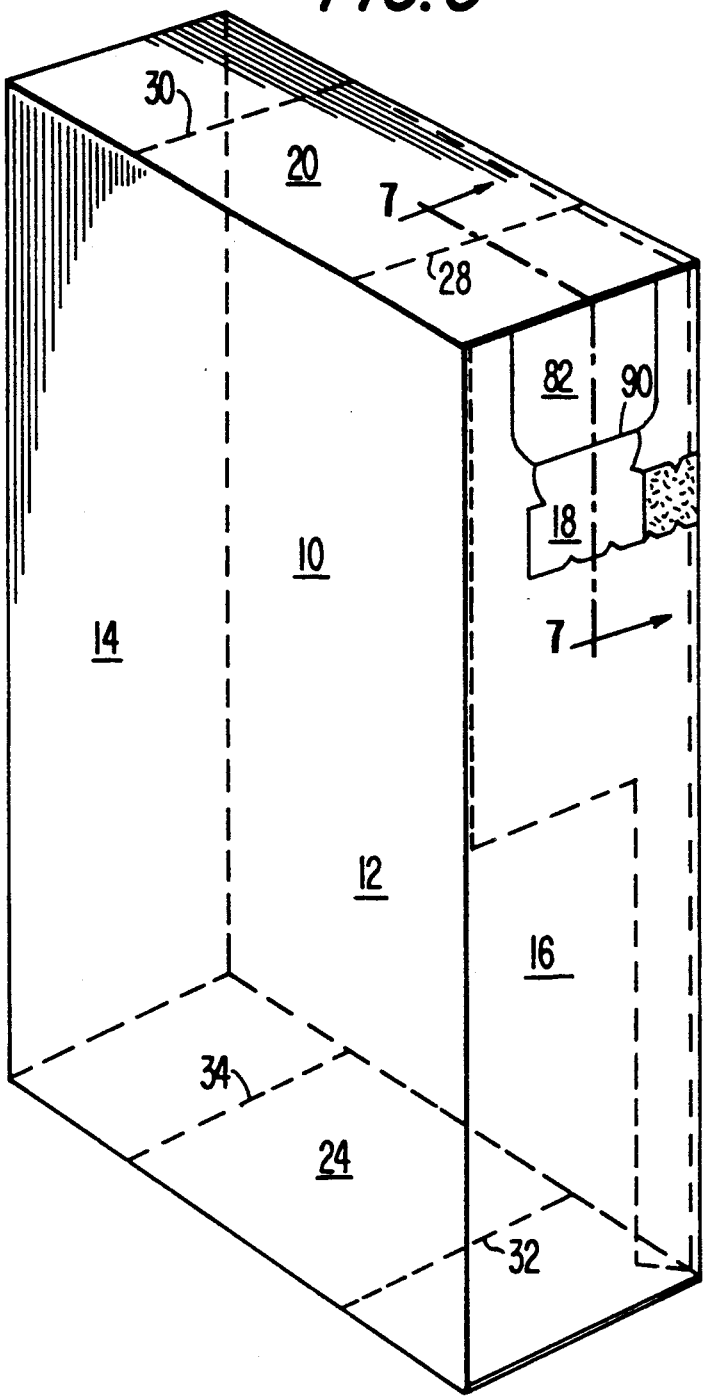
FIG. 6 is a perspective view of a carton in accordance with an alternative embodiment of the invention in the partially reclosed condition.
Figure 7:
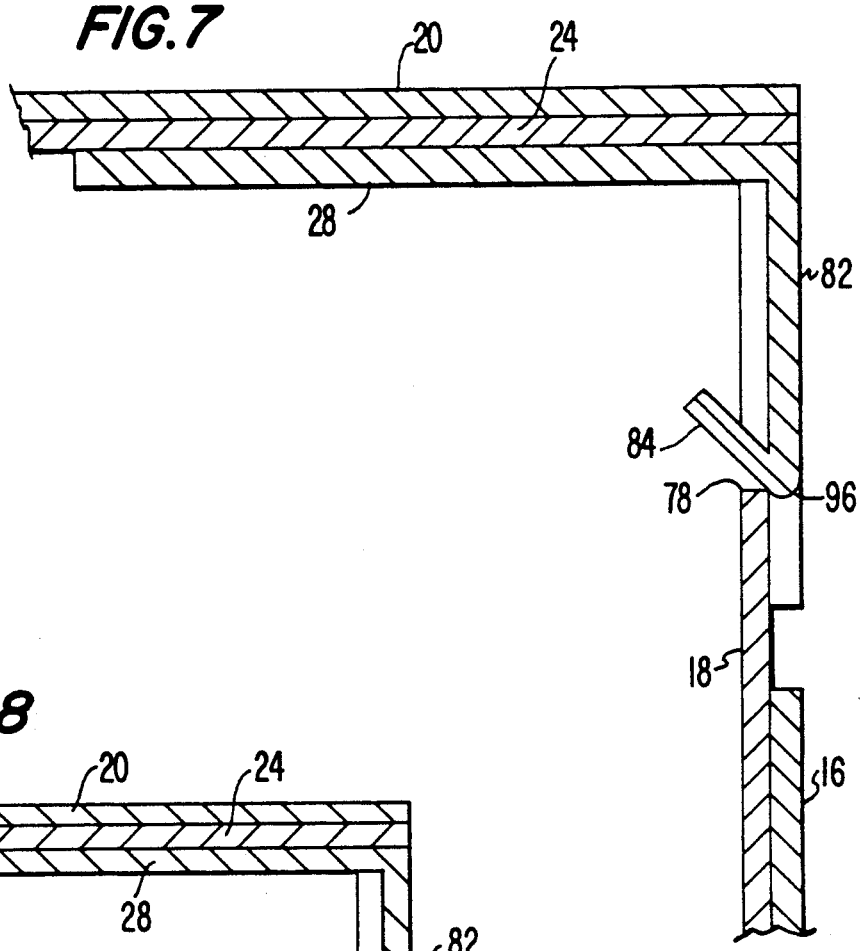
FIG. 7 is an expanded cross-sectional view of the partially reclosed carton taken along line VII—VII of FIG. 6.
Figure 8:
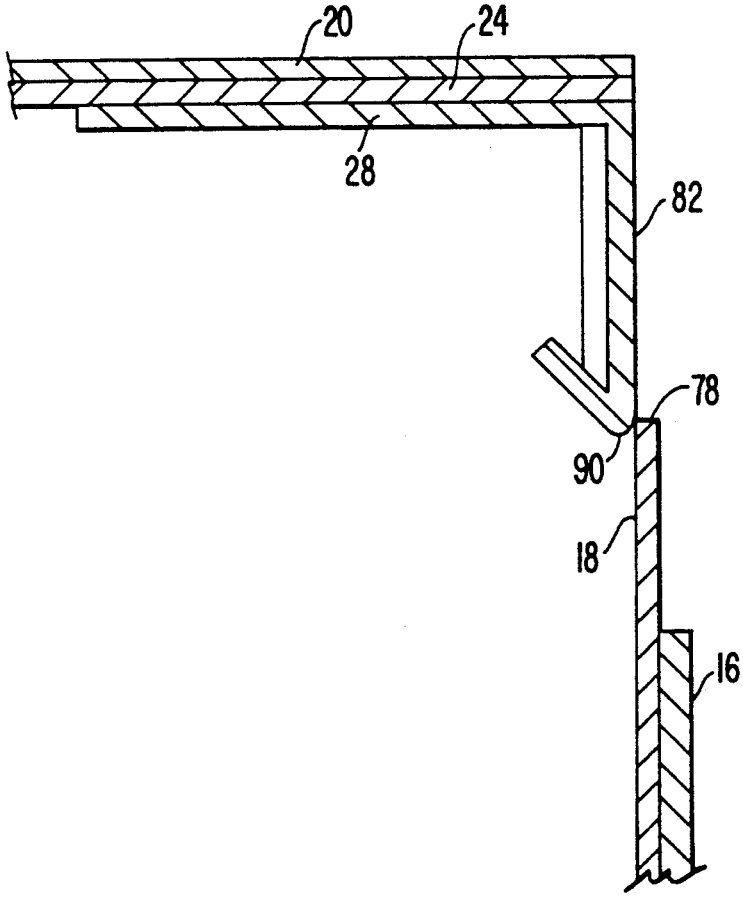
FIG. 8 is an expanded cross-section view of a fully reclosed carton taken along line VII—VII of FIG. 6.

An alternative to the above-mentioned reclosure feature is illustrated in FIGS. 6, 7 and 8. As can be noted from FIG. 7, the fold line 90 extends beyond the lower die-cut line 78 of the T-shaped pour spout opening. By extending the fold line 90 below the die-cut line 78, when the lift tab 84 is inserted into the pour spout opening 60, the lift tab will fold back toward the underside of the closure flap 82 so as to retain the closure flap 82 in a closed condition. To fully close the carton, the consumer need merely apply pressure to the closure flap 82 which will snap the fold line 90 over the edge defined by die-cut line 78 and further retain the closure flap 82 within the carton as shown in FIG. 8. In order to release the closure flap 82, the consumer must apply pressure to the outer side of partial panel 18 below die-cut 78 which will allow the closure flap 82 to exit the carton and provide the consumer access to the fold line 90 to reopen the carton. Consequently the secondary lift tab 86 may be eliminated.

While the invention has been described with reference to preferred embodiments, it should be appreciated by those skilled in the art, that the invention may be practiced otherwise than as specifically described herein without departing from the spirit and scope of the invention. It is, therefore, to be understood that the spirit and scope of the invention be limited only by the appended claims.

Industrial Applicability

The above described reclosable carton and reclosable opening feature may incorporated in a variety of paperboard blanks used for containing contents wherein it is desired to pour such contents from the carton when needed. The particular opening feature may be formed in any side wall as well as a top and bottom wall of a carton formed of paperboard material.

I claim:

1. A blank for forming a carton having a tear open pour spout for dispensing contents of the carton comprising:

a first main panel having first and second side panels and end flaps hingedly connected thereto by way of fold lines;

a second main panel hingedly connected to said second side panel and having a third side panel and end flaps hingedly connected thereto by way of fold lines;

a discharge opening formed in said third side panel;

a closure flap integrally formed in said first side panel having an opening means for opening said closure flap; and a releasing means at least partially separable from and integrally formed in said first side panel for releasing and permitting access to said opening means;

wherein said first side panel overlies said third side panel when said carton is formed so that said closure flap covers said discharge opening.

2. The paperboard blank as defined in claim 1, wherein said first and second side panels each include at least one end flap hingedly connected thereto at a crease score fold line.

3. The blank as defined in claim 2, wherein said closure flap is hingedly connected to said first side panel at said crease score fold line formed between said first side panel and said end flap connected to said first side panel.

4. The blank as defined in claim 3, wherein said blank is formed of paperboard and said closure flap includes at least one pair of reverse cut score lines extending from said crease score fold line to said opening means, such that upon application of an opening force an area of paperboard material between said reverse cut scores will ply separate and release said closure flap.

5. The blank as defined in claim 1, further comprising a partial cut score release area formed in said third side panel and in registering relationship with a portion of said releasing means when said blank is in its formed condition.

6. The blank as defined in claim 1, wherein said third side panel includes an adhesive coated area for securing said first side panel to said third side panel, and an area which underlies said opening means and a portion of said releasing means which is devoid of adhesive.

7. The blank as defined in claim 6, wherein said adhesive coated area includes a pair of adhesive regions which extend substantially parallel to said fold line connecting said third side panel to said second main panel and an edge of said third side wall, and said area devoid of adhesive extends from said discharge opening and between said pair of adhesive regions.

8. The blank as defined inn claim 1, wherein said opening means is a primary lift tab and is hingedly connected to said closure flap along a fold line.

9. The blank as defined in claim 8, further comprising a secondary lift tab integrally formed in said primary lift tab, wherein said secondary lift tab is defined by a pair of convergent cut scores, said fold line between said closure flap and said lift tab and a lower cut score spaced below and extending substantially parallel to said fold line and extending between said convergent cut scores, with said convergent cut scores extending from said fold line to a point below said lower cut score.

10. A carton having a reclosable tear open pour spout for dispensing contents of the carton comprising:

a plurality of side walls hingedly connected to one another by way of fold lines, a top wall and a bottom wall, with one of said side walls including an outer panel and an inner pannel adhesively secured thereto;

a discharge opening formed in said inner panel;

a closure flap integrally formed in said outer panel and overlying said discharge opening;

an opening means integrally formed in said outer panel and extending from said closure flap for opening said closure flap; and a releasing means at least partially separable from and integrally formed in said outer panel for permitting access to said opening means.

11. The carton as defined in claim 10, wherein said opening means is a lift tab hingedly connected to said closure flap by way of a fold line.

12. The carton as defined in claim 11, wherein a portion of said top wall is hingedly connected to said outer panel by way of a crease score fold line.

13. The carton as defined by claim 12, wherein said closure flap includes at least one pair of reverse cut score lines extending from said crease score line to said fold line between said closure flap and said lift tab, such that upon application of an opening force an area between said reverse cut scores will ply separate and release said closure flap.

14. The carton as defined in claim 13, wherein said closure flap includes two pairs of said reverse cut scores extending substantially parallel to one another and defining said closure flap.

15. The carton as defined in claim 10, wherein said releasing means is a tear strip defined by a pair of substantially parallel interrupted cut score lines with one of said cut score lines being adjacent said opening means.

16. The carton as defined in claim 10, further comprising a partial cut score release area formed in said inner layer and in registering relationship with a portion of said releasing means, such that a ply separation occurs at said area in said inner layer when said releasing means is removed.

17. The carton as defined in claim 10, wherein said inner layer includes an adhesive area for securing said outer layer to said inner layer, and an area which underlies said opening means and a portion of said releasing means which is devoid of adhesive.

18. The carton as defined in claim 17, wherein said adhesive area includes a pair of adhesive regions which extend substantially parallel to said fold line between said side walls and said area devoid of adhesive extends from said discharge opening and between said pair of adhesive regions.

19. The carton as defined in claim 11, further comprising a secondary lift tab integrally formed in said lift tab and defined by a pair of convergent cut scores, said fold line between said closure flap and said lift tab and a lower cut score spaced below and extending substantially parallel to said fold line and extending between said convergent cut scores, with said convergent cut scores extending from said fold line to a point below said lower cut score.

20. The carton as defined in claim 10, wherein said opening means is greater in width than said discharge opening such that said opening means may be inserted into and retained within said discharge opening to reclose said carton.

21. A blank for forming a carton having a tear open pour spout for dispensing contents of the carton comprising:

a first main panel having first and second side panels and end flaps hingedly connected thereto by way of fold lines;

a second main panel hingedly connected to said second side panel and having a third side panel and end flaps hingedly connected thereto by way of fold lines;

a discharge opening formed in said third side panel;

a closure flap integrally formed in said first side panel having an opening means for opening said closure flap; and a releasing means integrally formed in said first side panel for releasing and permitting access to said opening means, said releasing means being a tear strip defined by a pair of substantially parallel interrupted cut score lines with one of said cut score lines being adjacent said opening means;

wherein said first side panel overlies said third side panel when said carton is formed so that said closure flap covers said discharge opening.

* * * * *